US005797152A

United States Patent [19]

Wiesch

[11] Patent Number: 5,797,152

[45] Date of Patent: Aug. 25, 1998

[54] BEDSTEAD FOR SINGLE BEDS, WHICH CAN BE ASSEMBLED PAIRWISE, ADJACENT TO ONE ANOTHER, INTO A DOUBLE BED

[76] Inventor: Gerhard Wiesch, Am Thietor 2, D-48431 Rheine, Germany

[21] Appl. No.: 741,447

[22] Filed: Oct. 31, 1996

[30] Foreign Application Priority Data

Nov. 6, 1995 [DE] Germany ..... 195 41 267.2

[51] Int. Cl.[6] ..... A47C 19/04

[52] U.S. Cl. ..... 5/8; 5/11; 5/511; 5/170; 5/286

[58] Field of Search ..... 5/8, 11, 170, 186.1, 5/400, 663, 510, 511, 907, 286, 310, 131

[56] References Cited

U.S. PATENT DOCUMENTS

| | | | |
|---|---|---|---|
| 1,323,229 | 11/1919 | Borhauer | 5/8 |
| 2,862,213 | 12/1958 | Sonnenburg et al. | 5/511 |
| 3,072,927 | 1/1963 | Julin | 5/131 |
| 3,546,725 | 12/1970 | Tambascio | 5/286 X |
| 3,745,597 | 7/1973 | Kurtz | 5/510 |
| 4,084,276 | 4/1978 | Trexler, Jr. et al. | 5/8 |
| 4,524,471 | 6/1985 | Mansouri et al. | 5/8 |
| 4,648,141 | 3/1987 | Mansouris et al. | 5/8 |

FOREIGN PATENT DOCUMENTS

| | | | |
|---|---|---|---|
| 2 107 977 | 5/1983 | United Kingdom | 5/8 |

*Primary Examiner*—Michael F. Trettel
*Attorney, Agent, or Firm*—Jordan and Hamburg

[57] ABSTRACT

A bedstead for single beds, which can be assembled pairwise, adjacent to one another, into a double bed, particularly hotel beds, with a peripheral bed frame, which surrounds the region for accommodating at least one mattress and encircles the mattress in a lower part, is configured in such a way that the bed frame consists of least one narrow-walled metal plate which, at least at the longitudinal sides of the bedstead, is set so far to the inside with respect to the outline of the mattress(es), that its external surfaces do not protrude beyond the outline of the mattress, in order to make it possible that the mattress is held securely and stably on the bedstead and that the transition between the two mattresses is almost gapless in the assembled position.

21 Claims, 16 Drawing Sheets

8
26
9
10
28
29
29

33
34
31
36
38
37
41
34
40
39
33
28
32
35

BEDSTEAD FOR SINGLE BEDS, WHICH CAN BE ASSEMBLED PAIRWISE, ADJACENT TO ONE ANOTHER, INTO A DOUBLE BED

BACKGROUND OF THE INVENTION

The invention relates to a bedstead for single beds, which can be assembled pairwise, adjacent to one another, into a double bed.

In the hotel trade, it is desirable to fit out rooms with two beds, which stand next to one another and thus form a double bed or stand apart and form two single beds, in order to obtain a high occupancy rate for the room. The problem here is to bring the two beds into the position of a double bed, in which they are next to one another, so close to one another, that the two mattresses go over into one another almost without a gap. In this connection, it is known that a bed frame may be omitted, so that the mattress lies loosely on the lath grid. However, it is a disadvantage here that the mattress "wanders" on the bedstead.

Furthermore, single beds with wooden frames for surrounding mattresses at the sides are known, which stand next to one another as a double bed and leave a space between the mattresses.

SUMMARY OF THE INVENTION

It is an object of the invention to create a bedstead, which enables the mattress to be held securely and stably on the bedstead as well as the transition between the two mattresses to be almost without a gap, when the two beds are placed next to one another.

According to the invention, a narrow-walled metal plate is used for the bed frame which, at least at the longitudinal side of the bedstead, is set so far towards the inside with respect to the outline of the mattress that its outer surfaces do not protrude beyond the outline of the mattress. In this way, the mattress is fixed securely by simple means in the bedstead, since it is held with accurate fit by the metal plate. Since the metal plate has a narrow wall and its outer surfaces do not protrude beyond the outline of the mattress, the outer sides of the mattress come together when the two beds are moved together into a double bed, so that a continuous lying surface results on the upper side.

Further details and advantages of the invention arise out of the following description and the accompanying drawings.

BRIEF DESCRIPTION OF THE INVENTION

FIGS. 1*a–d* show a diagrammatic representation of the inventive bedstead in various views (a: plan view, b: front view, c: rear view, d: side view), FIG. 2 sectionally shows the bedstead of FIG. 1 with the mattress lying on the bedstead, FIGS. 3*a* to 3*c* and 3*e* are sectionally views which show different positions of two single beds, which can be pushed together into a double bed, FIG. 4 shows a detailed representation of the bedstead of FIG. 1 in various views (a: plan view, b: side view), FIGS. 5*a–c* show a base for the bedstead in different views (a . . .

FIGS. 6*a–d* show the base of FIG. 5 with elements of a driving mechanism (a: front view, b: plan view, c: section along the line A—A in FIG. 6*a, d:* . . .

FIGS. 7*a–c* show the base of FIG. 5 with a support in different . . .

FIGS. 8*a–b* shows the support of FIG. 7 in different views (a: front view, b: plan view), FIGS. 9*a–d* show a representation of the transverse bar of FIG. 4 in different views (a: front view, b: plan view, c: rear view, d: side view), FIG. 10 shows a section along the line X—X in FIG. 4*a*, FIG. 11 shows a representation of the bed frame of FIG. 4 in an internal view, FIG. 12 shows an enlarged and supplemented representation of a section from FIG. 10, FIG. 13 shows a sectional representation of the connection of the frame to the transverse bar, FIG. 14 shows a sectional representation through the frame, which is connected with the transverse bar and covered with a material, FIGS. 15*a–b* show a representation of FIG. 14 without the material covering, FIGS. 16*a–b* show a plan view of a transverse bar in the region of the connection to the frame, FIG. 17 shows a detailed and supplemented representation of a section from FIG. 4 and FIGS. 18*a–b* show a locking profile with a locking peg in different views (a: plan view, b: side view).

DESCRIPTION OF THE PREFERRED EMBODIMENT

Figures 1A, 1B, 1C, 1D:
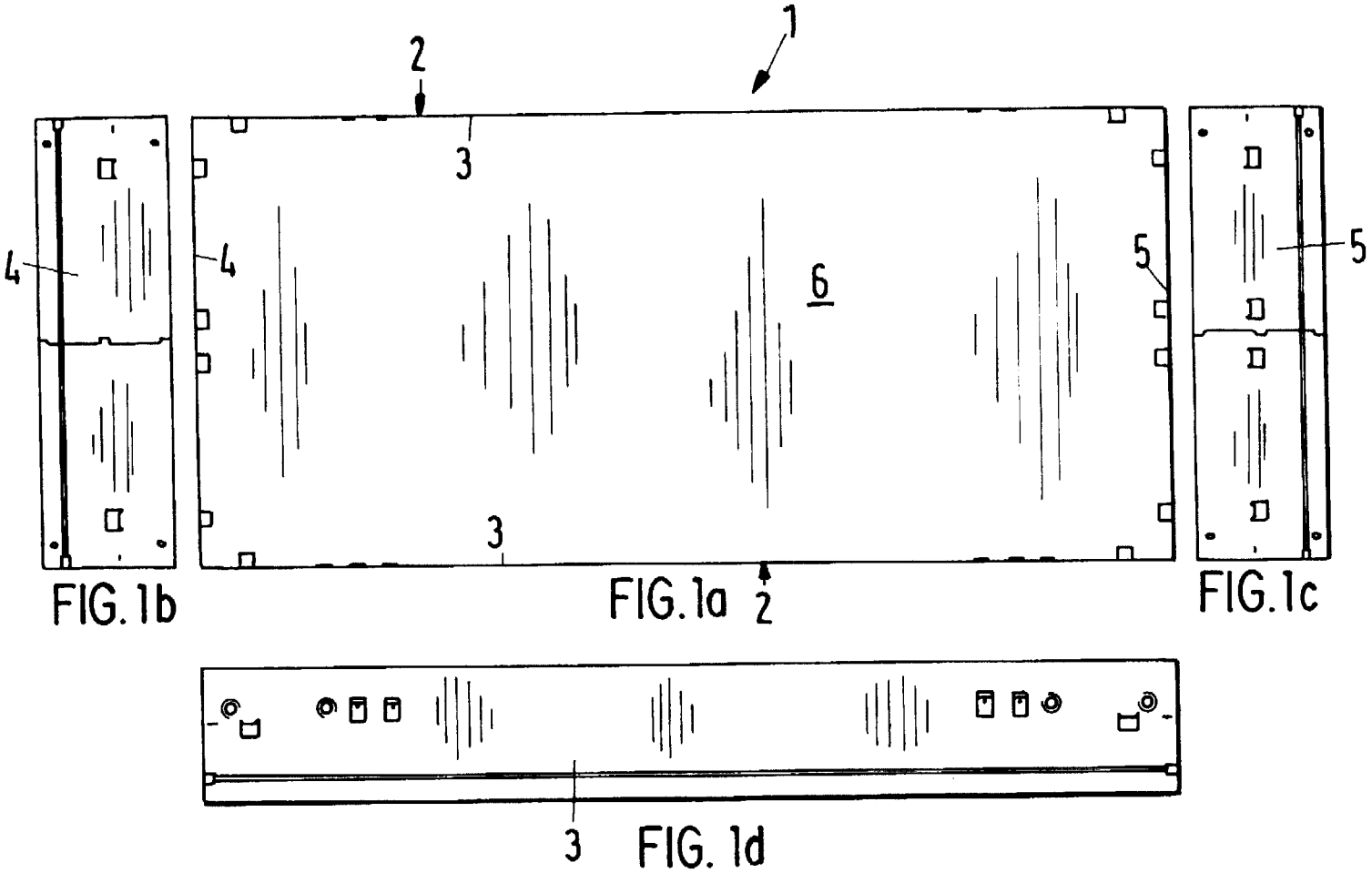
Figure 2:
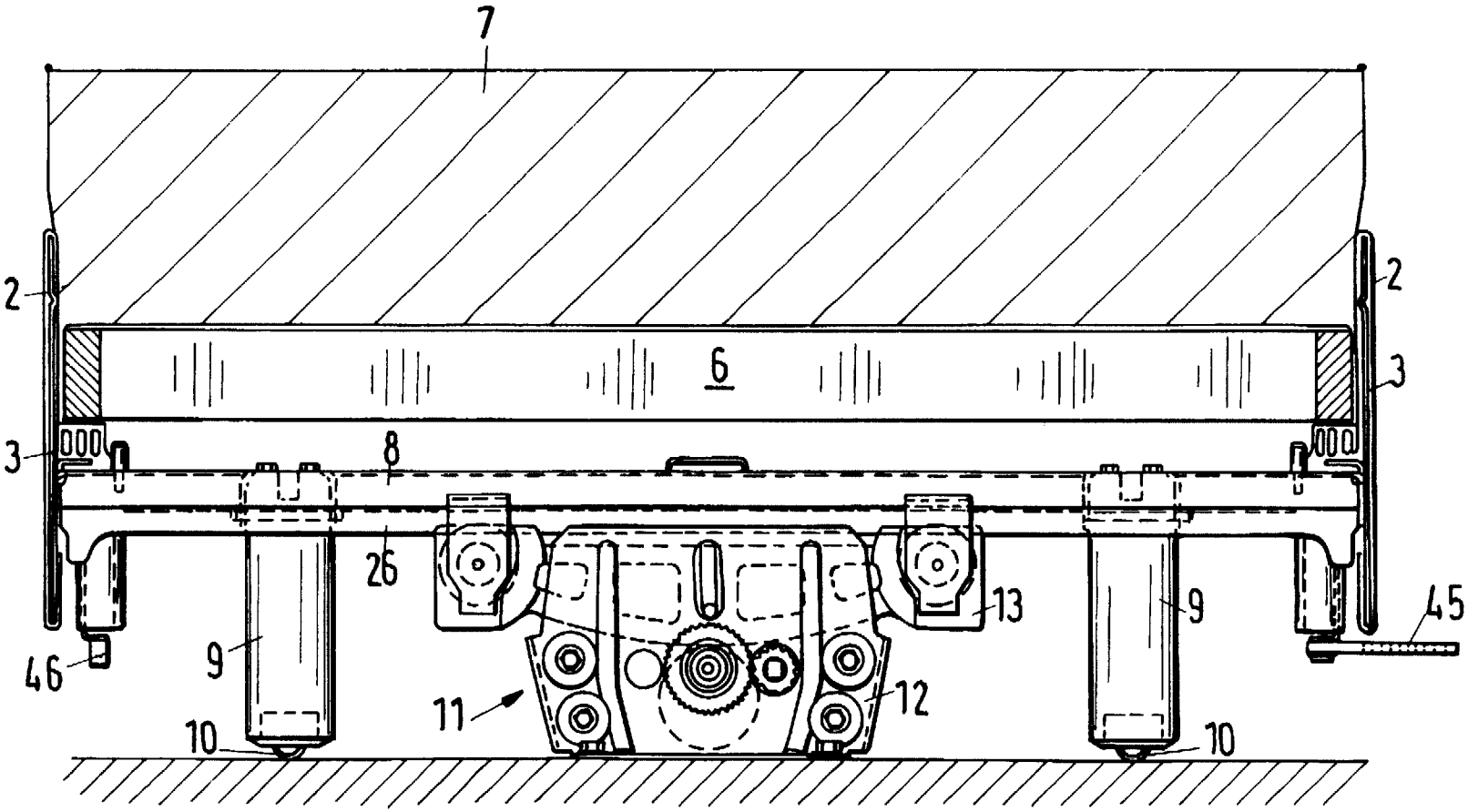

The bedstead, shown diagrammatically in FIG. 1, comprises a bed frame 1, which consists of two narrow-walled metal plates 2, which are bent over at the corners and, together, form two side frame parts 3, a foot frame part 4 and a head frame part 5. By bending, sharp edges are avoided in the corner regions, which could represent a source of danger, particularly when the beds are shifted. The metal plates 2 consist preferably of aluminum, since by these means a bedstead of low weight can be attained. Moreover, they have a reinforcing corrugation or the like, in order to attain the necessary strength. The frame parts 3, 4, 5 border an accommodating region 6 for accommodating a mattress 7 shown in FIG. 2. FIG. 2 shows that the frame 1 encloses approximately one-third the height of the mattress, so that its lower region is clamped between the metal plates 2 and its upper region protrudes above the width of the metal plates 2. When these two beds are placed together to form a double bed, the mattresses are in contact and a gapless transition region is created.

Figures 4A, 4B:
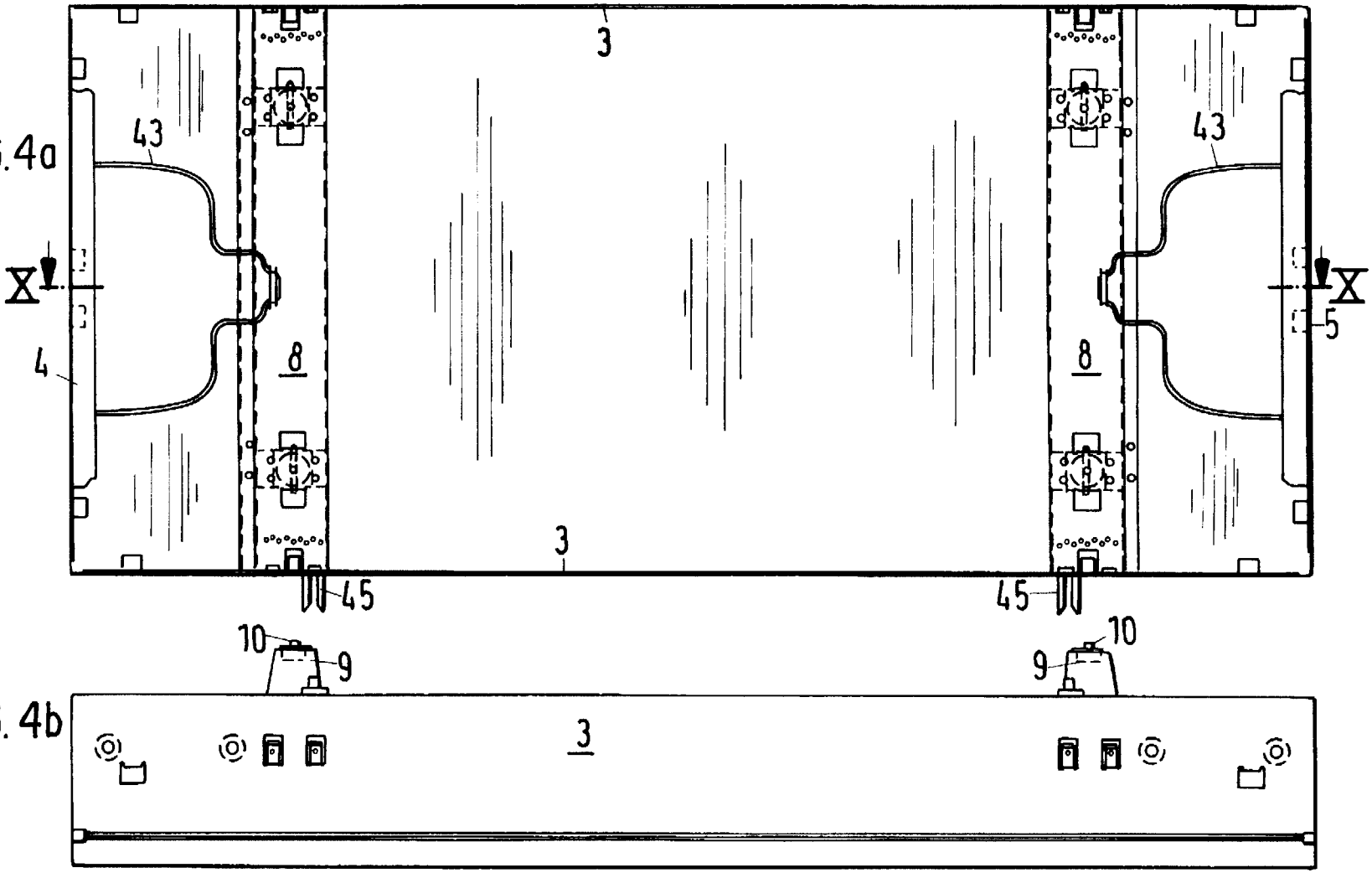

As is evident from FIG. 4, the bedstead comprises two transverse bars 8, to which the metal plates 2 can be fixed detachably. By these means, a central structural element is created, at which the remaining elements of the bedstead are held. To the underside of each of the transverse bars 8, two setting-up feet 9 are bolted or similarly mounted in order to keep the mattress 7 at some distance from the floor. Furthermore, the setting-up feet 9 are provided at their underside with rollers 10, which facilitate shifting the bedstead.

Figures 3A, 3B, 3C, 3E:
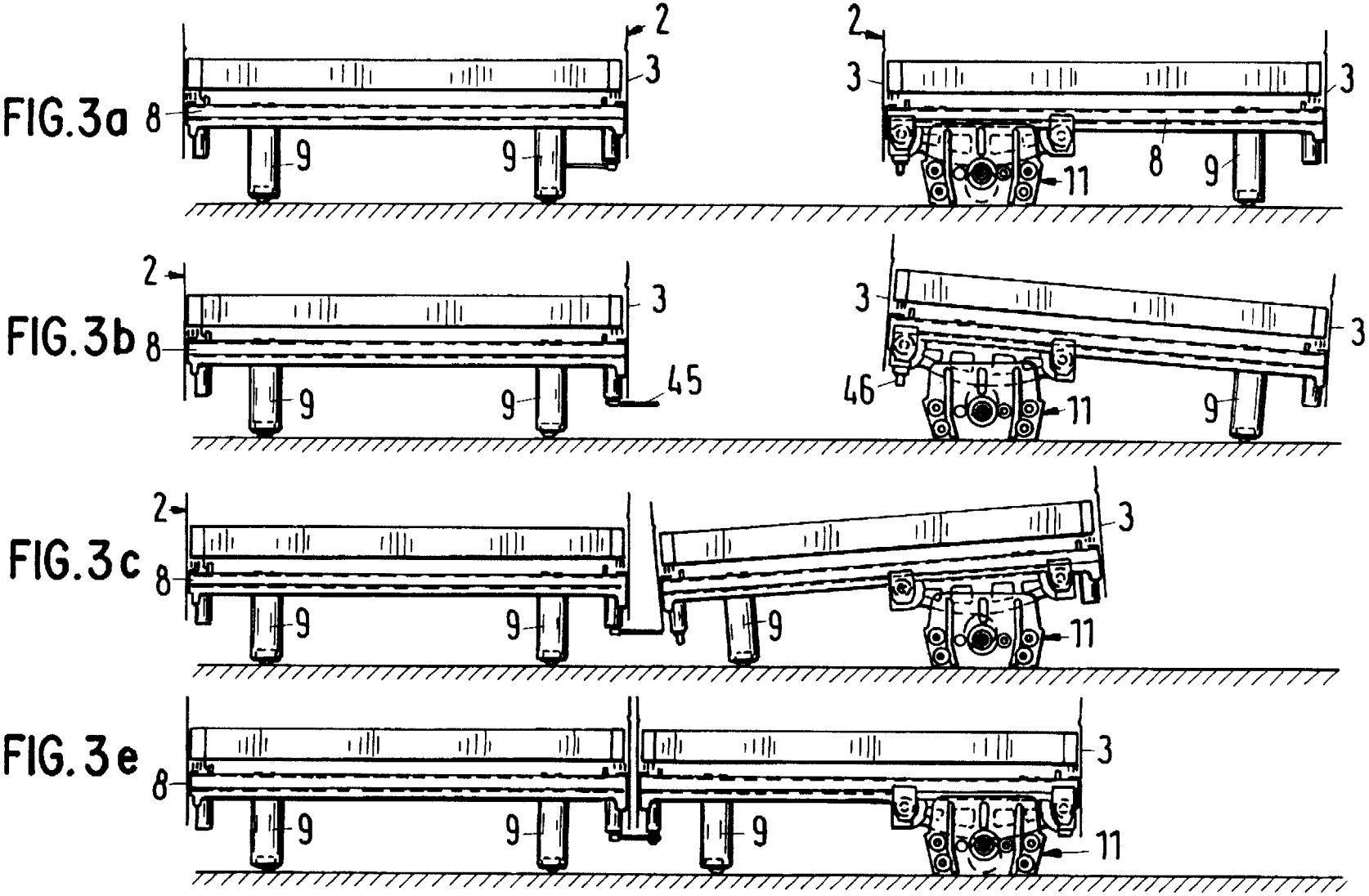

For shifting the bedstead, the transverse bars 8 are connected with a shifting mechanism 11, which enables the two beds to be moved together or moved apart quickly. Particularly in the hotel trade, it is important to have a mechanism available, which enables the two beds to be put together or moved apart within a short time, because this has to be done by a chambermaid so that, for economic reasons, the time and effort involved for this should be a minimum. Furthermore, any traces on the carpet due to shifting the beds should be minimized. A representation of the different positions while moving apart or putting together the two beds by means of the shifting mechanism 11 is illustrated in FIG. 3.

Figure 5C:
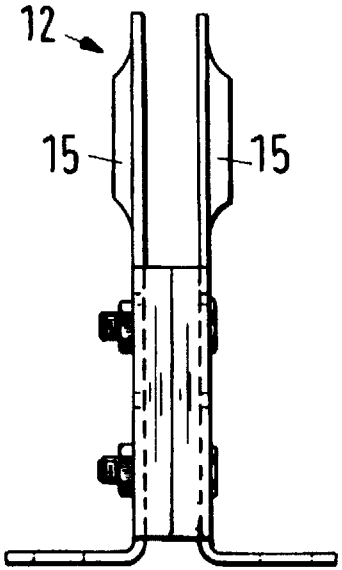
Figure 5A:
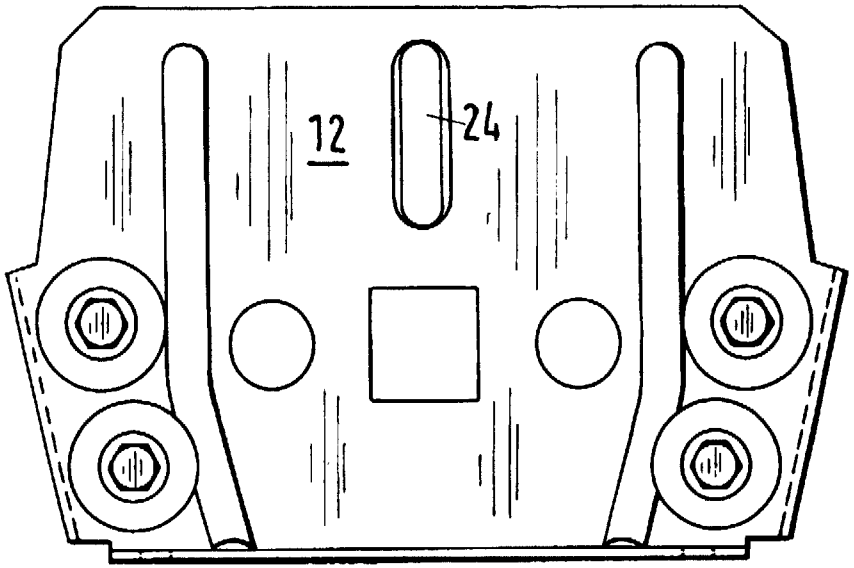
Figure 5B:
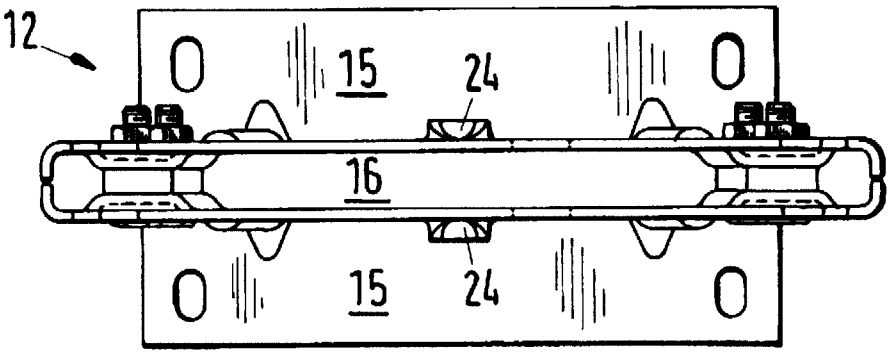
Figure 6C:
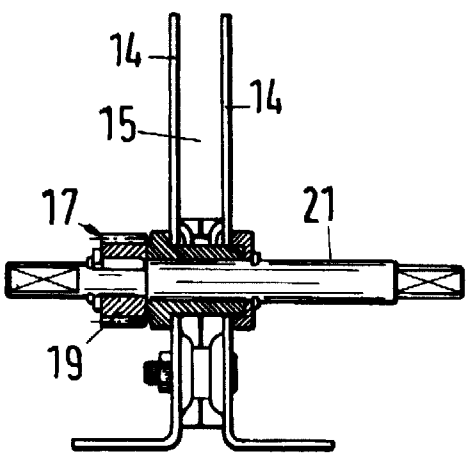
Figure 6D:
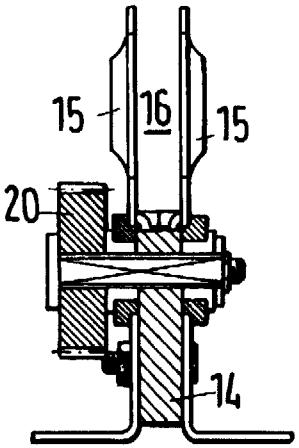
Figure 6A:
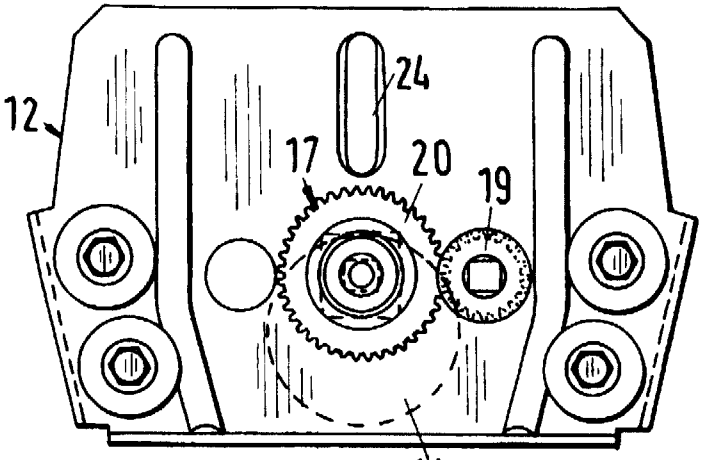
Figure 6B:
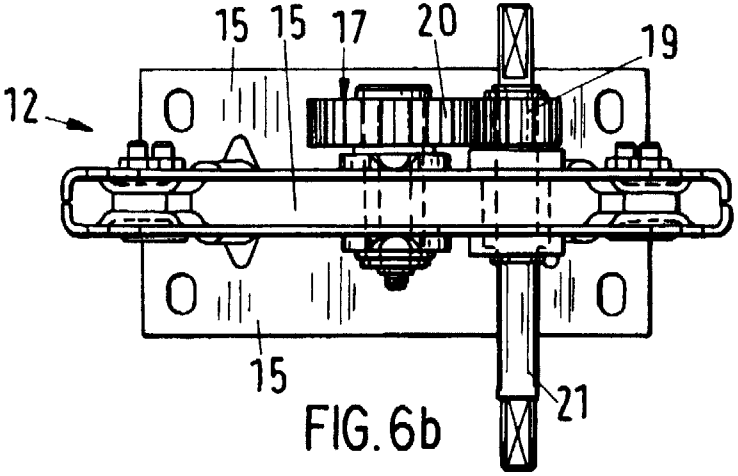

As shown in FIG. 2, the shifting mechanism 11 consists of a base 12, which is fixed to the floor, and a support 13 which, on the one hand, is mounted vertically movably relative to the base 12 from a setting-up position into a shifting position of the bed and, on the other, is connected horizontally movably with the transverse bar 8. By shifting the height of the bed, the force expended for shifting the bedstead is decreased appreciably. The change in height of the support 13 is made possible by means of an eccentric disk 14, which is shown in FIG. 6 and presses against the underside of the support 13 and, as it rotates, shifts the support 13 vertically. The eccentric disk 14 is mounted in the base 12. As shown in greater detail in FIG. 5, the base 12 consists of two half shells 15, which are bolted together. On the inside, they form the boundary of an accommodating space 16, which serves for mounting the eccentric disk 14 as well as for vertically guiding the support 13.

Figure 7C:
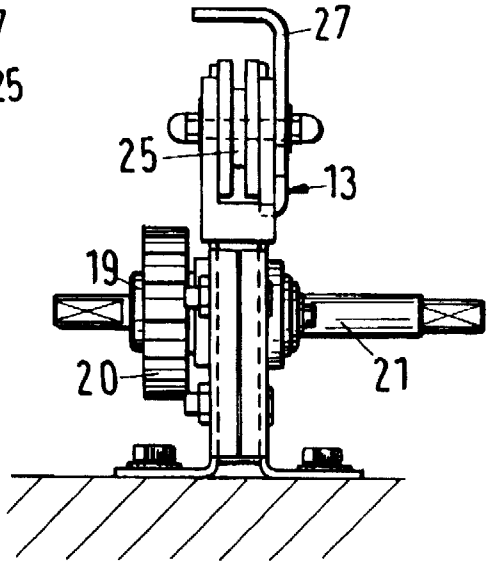
Figure 7A:
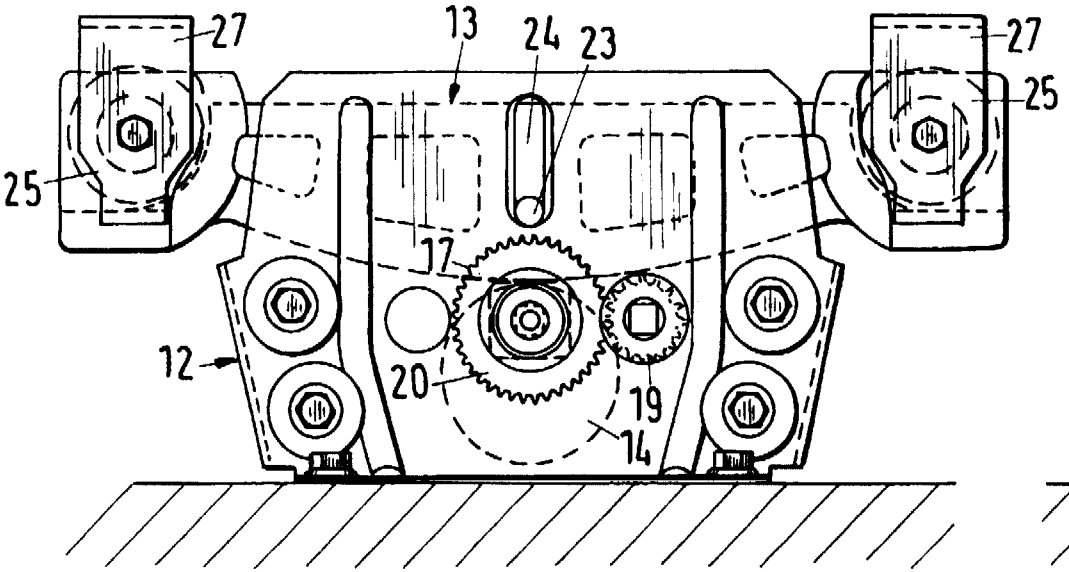
Figure 7B:
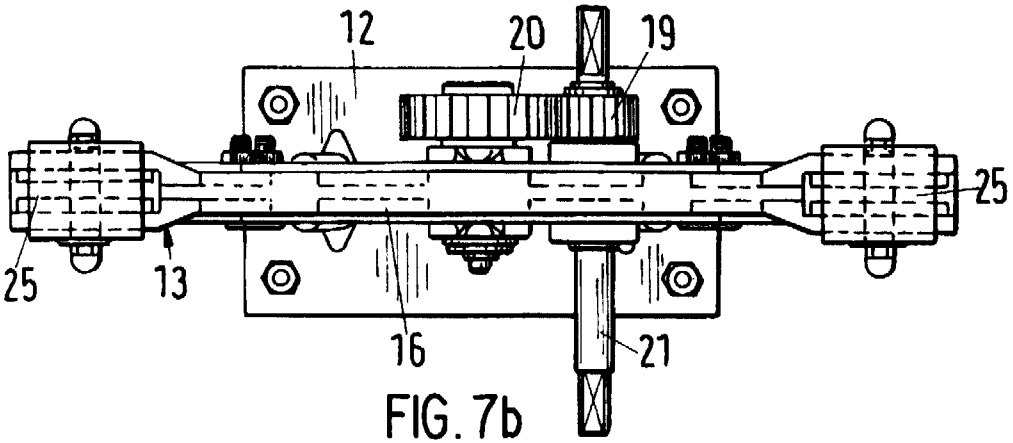
Figure 10:
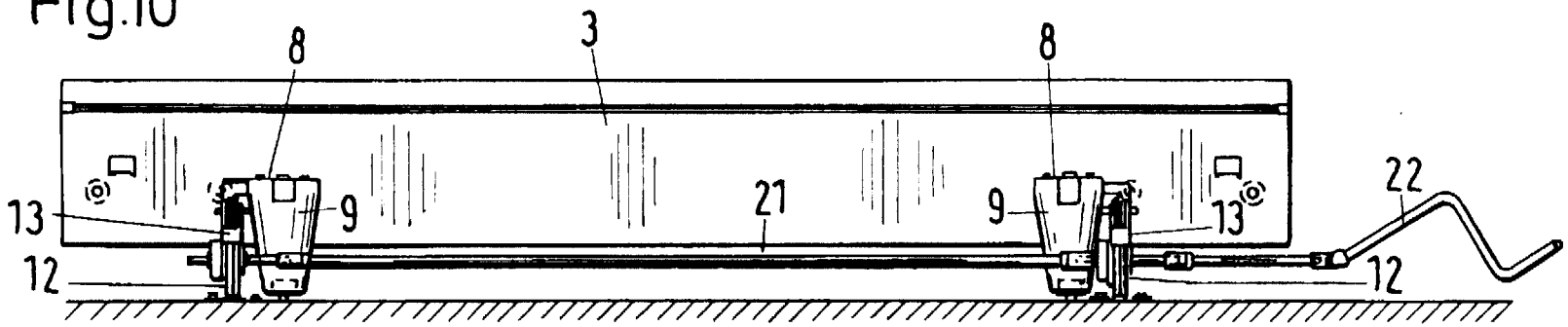
Figure 11:
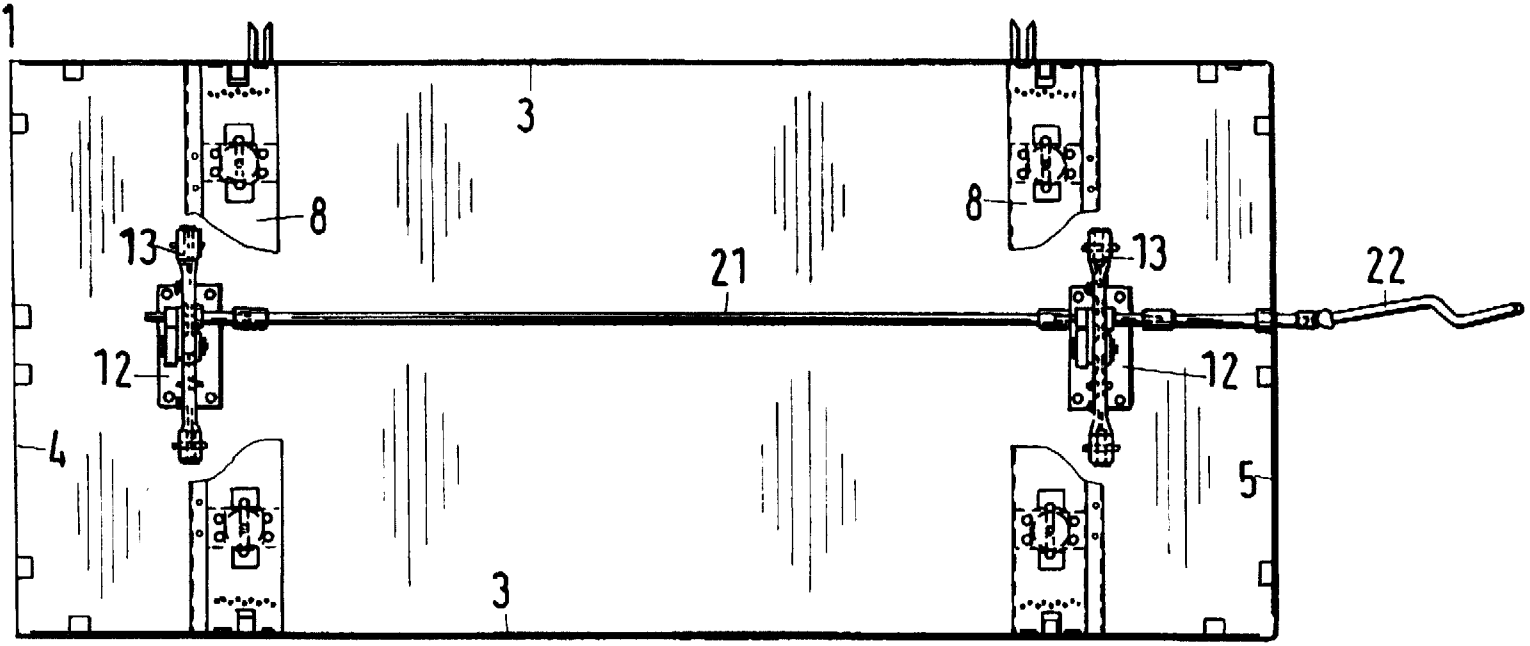
Figure 12:
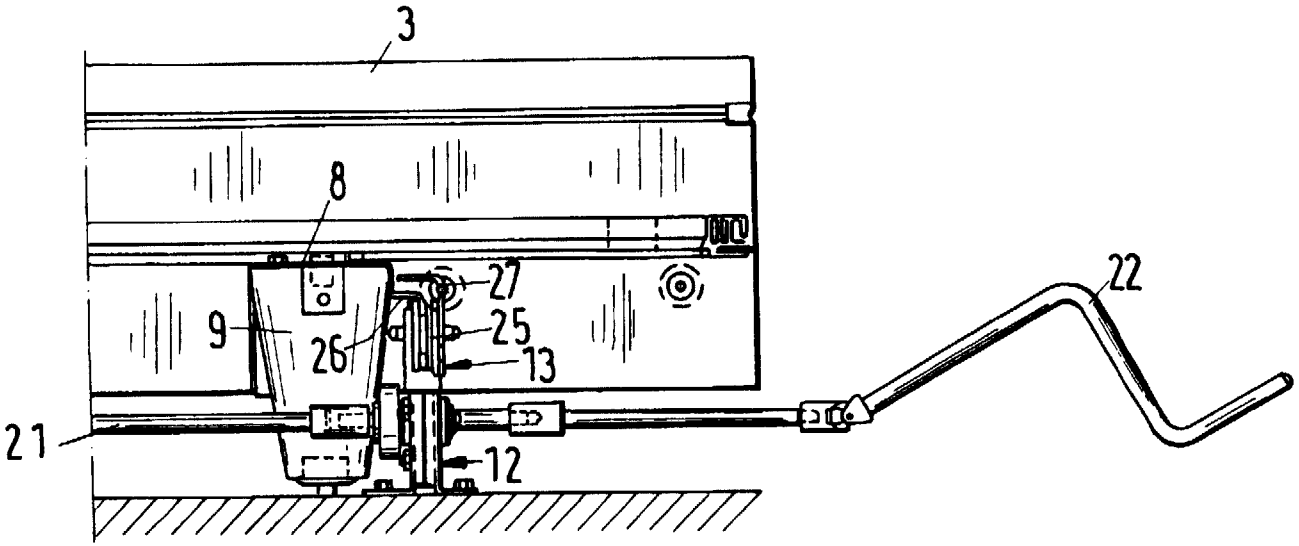

As shown in FIGS. 6 and 7, the eccentric disk 14 is caused to rotate by means of a driving mechanism 17, which consists of a smaller 19 and a larger 20 gear wheel, which mesh with one another, the smaller gear wheel 19 driving the larger one 20, which in turn drives the eccentric disk 14. As is evident from FIGS. 10 and 11, the small gear wheels 19 of the two shifting mechanisms 11 of the two transverse bars 8 are connected together by a shaft 21, so that the motion of the two shifting mechanisms 11 is coupled. FIG. 12 shows that a crank handle 22, with which the two small gear wheels 19 can be driven mechanically, can be slipped onto the shaft 21. It is, however, also conceivable to drive the two small gear wheels 19 electrically.

Figure 8A:
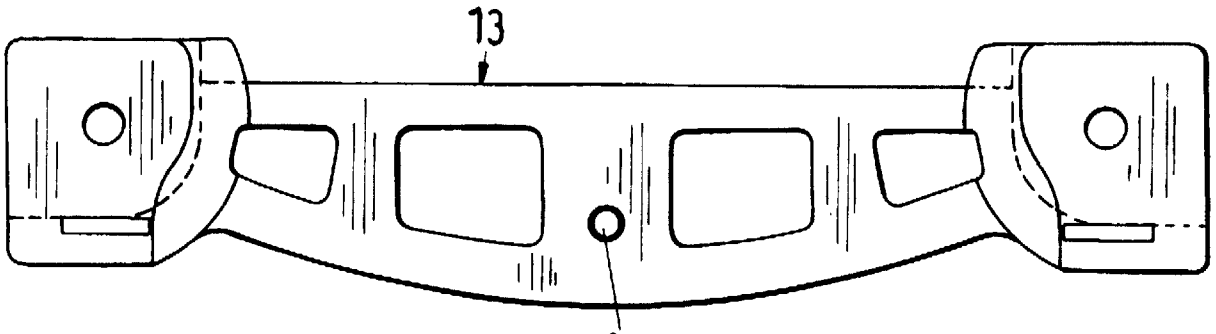
Figure 8B:
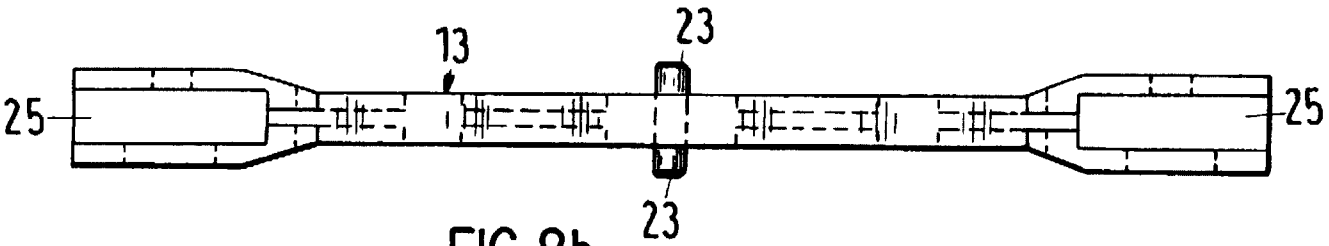
Figures 9A, 9B, 9C, 9D:
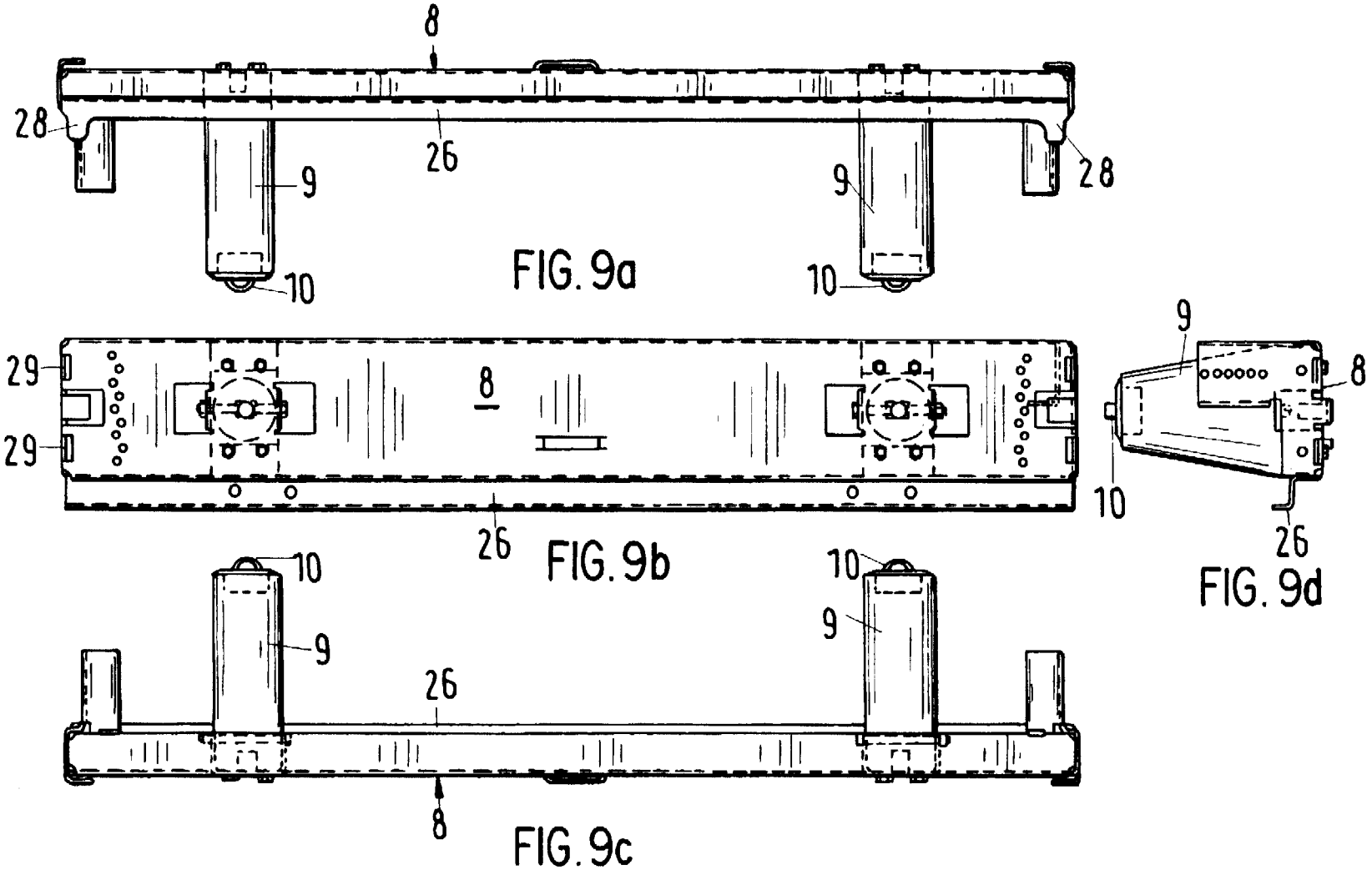

Furthermore, FIGS. 7 and 8 show that the support 13 is provided with a continuous inserted guiding slide pin 23, which at either end engages a vertically aligned elongated hole 24 in the half shells 15 of the base 12. In order to prevent wear of the elongated holes 24 in the half shell 15 and to improve the guidance of the guiding slide pin 23, the edges of the elongated holes 24 are reinforced with guiding flanges **24*a*, which are pressed into the elongated holes 24. At each end, the support 13 can take up a roller 25 for connection to the transverse bar 8. As is evident from FIG. 9, the transverse bar 8 is constructed at a longitudinal side as a sliding rail 26, so that the rollers 25 of the support 13 can take up the sliding rail 26. In order to ensure secure guidance of the rollers 25 of the support 13 on the sliding rail 26, a securing element 27, which overlaps the sliding rail 26 of the transverse bar 8, is provided in each case at the support 13**.

In order to change the bedstead from the double bed position, shown in FIG. 3, into single bed positions, the small gear wheels 19 are first of all turned by means of the crank handle 22 and, in turn, cause the eccentric disk 14 to be rotated through the action of the large gear wheels 20. The eccentric disk 14 presses against the underside of the support 13 and shifts this vertically in the upwards direction. By means of its guiding slide pin 23, which slides in the elongated holes 24, the support 13 is guided securely in the accommodating space 16 of the base 12. As a result of the upwards motion of the support 13, the bedstead is brought into an inclined position. The bedstead is now raised at the side opposite the support 13 and brought into a suspended position and the transverse bars 8 are shifted in a sliding manner over the support 13. After a desired distance from the other bed has been attained, the bed is placed on the floor once again on the other side. The support 13 is then moved downwards once again by means of the driving mechanism 17, so that all four setting-up feet 9 of the two transverse bars 8 once again have contact with the floor. The rollers 10 of the setting-up feet 9 enable the bed to be set up on the floor softly and in a sliding manner, so that any traces of abrasion on the carpet are minimized. The ends of the transverse bars 8 are each provided with a stop 28 for the support 13 in the form of a one-piece downwards projecting lug, which is connected with the transverse bar 8, so that a defined end position is specified. Overall, only a slight force need be employed to shift the bedstead by means of this shifting mechanism 11, so that particularly a chambermaid can shift the beds independently.

Figure 13:
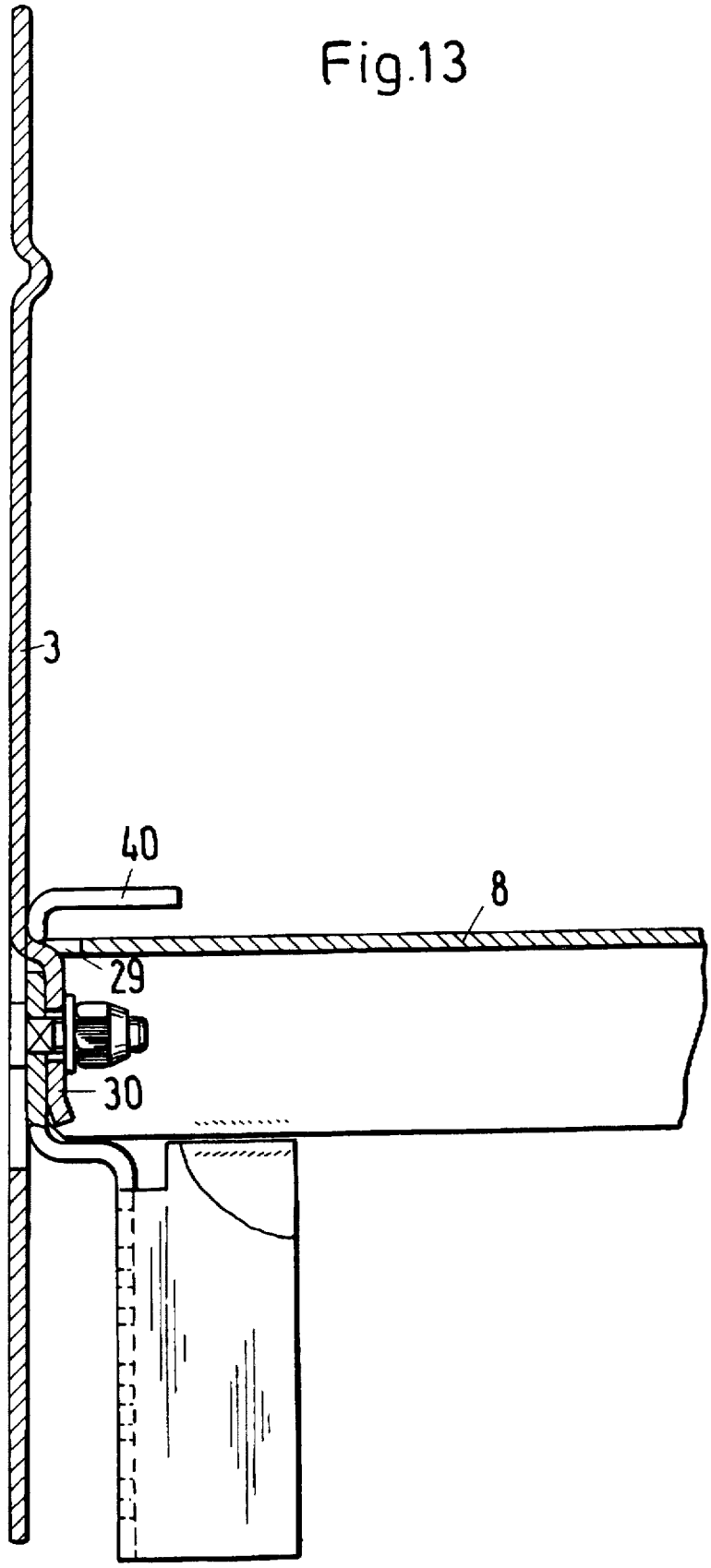

As shown in FIG. 13, the metal plates 2, for bordering the region 6 for accommodating the mattress 7, are fastened to the transverse bars 8. In order to make a linear configuration of the outside of the frame 1 possible, the transverse bars 8 have recesses 29, while both side frame parts 3 are provided with inwardly protruding tabs 30, which can be hung in the recesses 29 of the transverse bars 8. The tabs 30 can be bolted to the inside of the transverse bars 8, so that a firm connection to the transverse bars 8 is ensured. By means of this type of fastening, no outwardly protruding screw or bolt parts or the like are visible, which is particularly important when the frame 1 is lined with a material.

Figure 14:
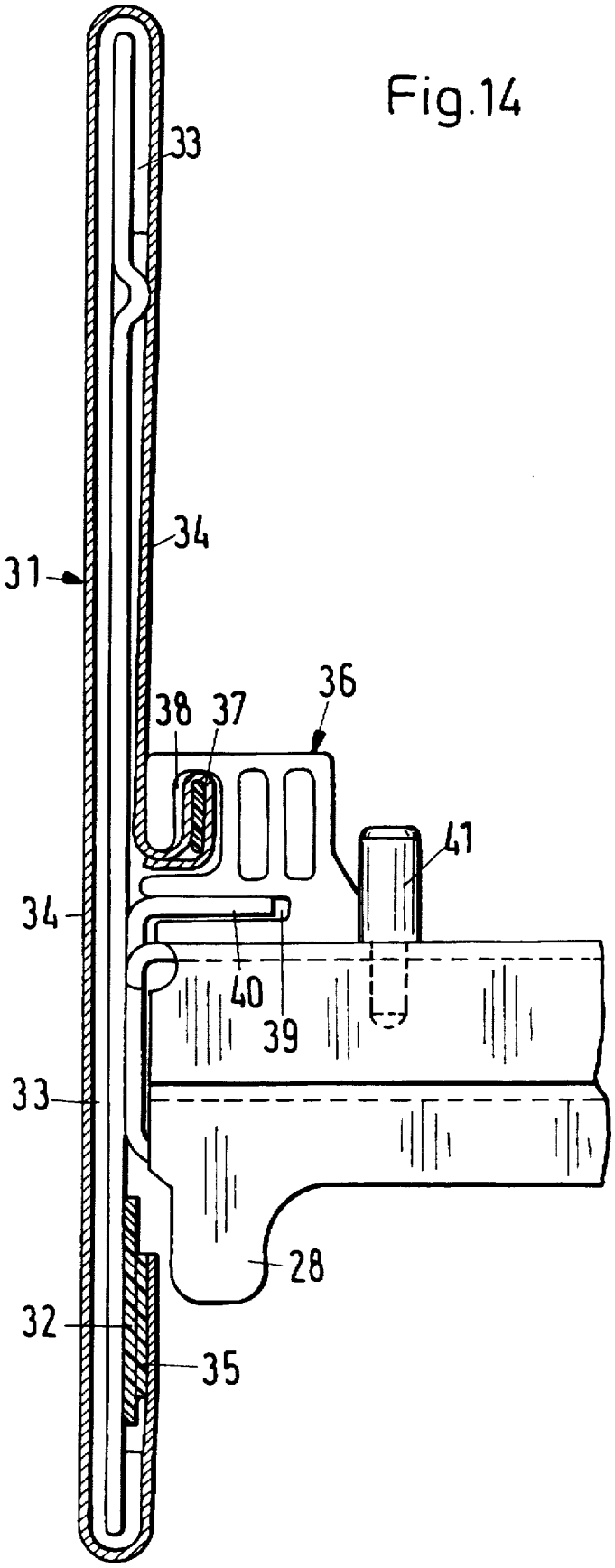

In FIG. 14, the frame 1 is covered with material 31. For this purpose, the lower edge of the frame parts 3, 4, 5 is in each case provided on the inside with hooks and loops tape 32 such as VELCRO (Trademark). Moreover, a felt or nonwoven material 33 can be glued to the frame parts 3, 4, 5 before a material 34 is fixed to the frame, so that an underlining is provided. The material 34 of the covering 31 is cut in such a manner, that it encloses and is tucked around the frame parts 3, 4, 5. At its lower edge, the material 34 likewise has a peripheral tape 35, which is connected with the Velcro tape 32 at the frame parts 3, 4, 5.

Figure 15A:
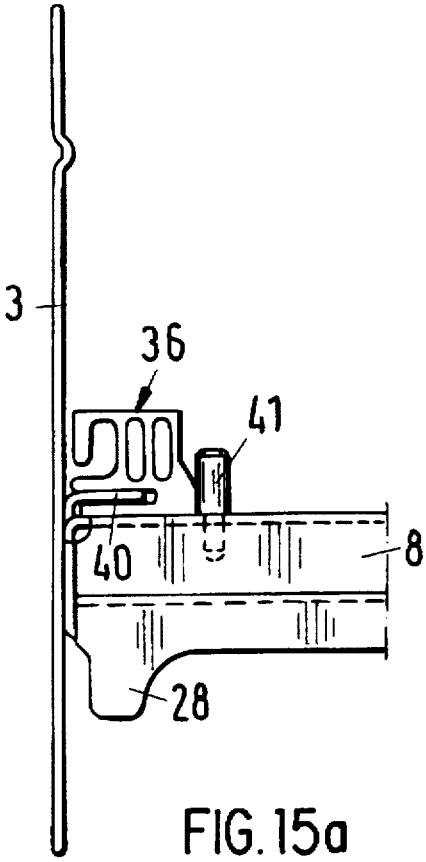
Figure 15B:
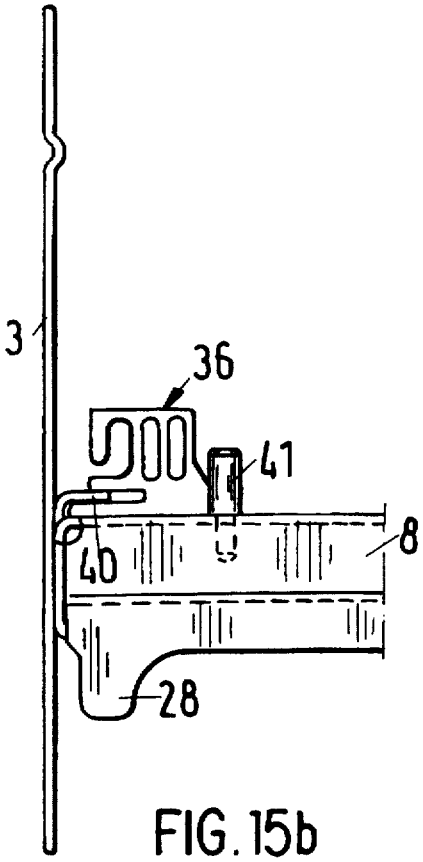
Figure 16A:
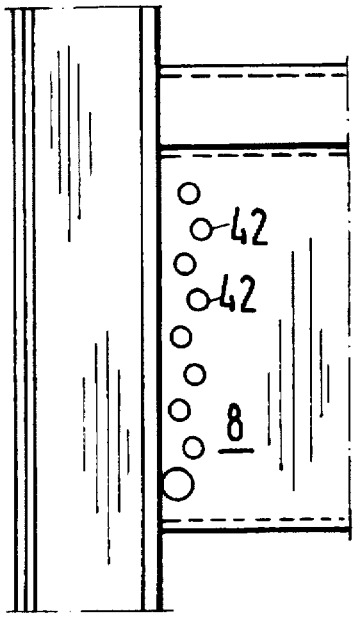
Figure 16B:
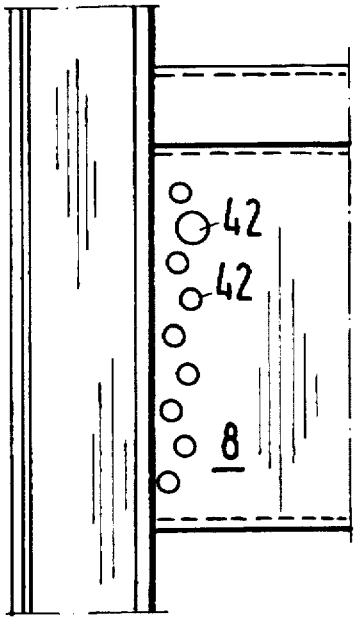

After the tapes 32, 35 are fastened, the material 34 is wrapped around the frame 1 and hooked into profiled legs 36 extending along the frame parts 3, 4, 5. For this purpose, a fastening welt 37, which endows the material 34 with sufficient final strength, is sewn to the upper edge of the material 34. The profiled leg 36 is provided with a recess 38 in such a manner that it can accommodate the welt 37. Furthermore, the profiled leg 36 has a further recess 39, which is constructed complementarily to the locking catches 40 at the transverse bars 8 and the frame parts 3, 4, 5 and is intended to hold the profiled leg 36 at the transverse bar 8 and the frame parts 3, 4, 5. In order to prevent the profiled leg 36 slipping to one side, it is furthermore fastened with a stopper 41 at the transverse bar 8. As is evident from FIG. 16, the transverse bar 8 has several boreholes 42, which are at different distances from the edge of the transverse bar. Since the distance of the profiled leg 36 from the side frame part 3 varies depending on the thickness of the material 34 selected, the optimum holding position can thus be fixed in each case. These different distances of the profiled leg 36 from the side frame part 3 are shown in FIG. 15.

Figure 17:
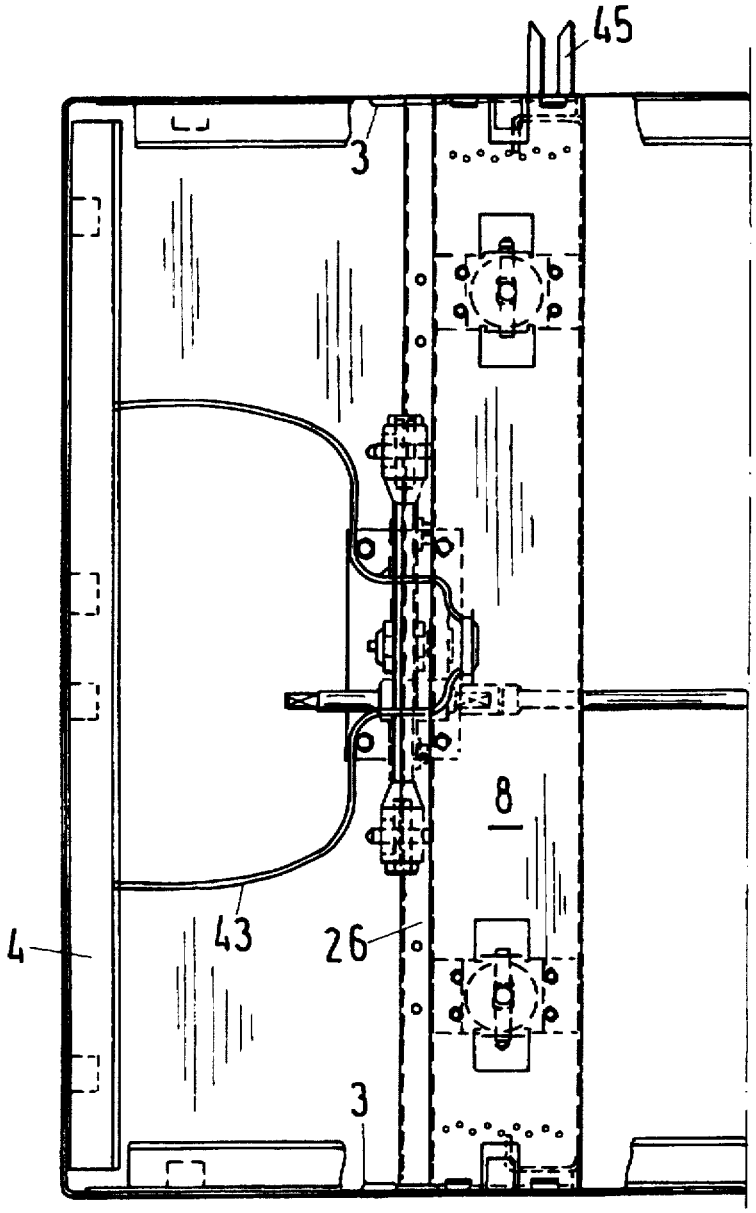
Figure 18A:
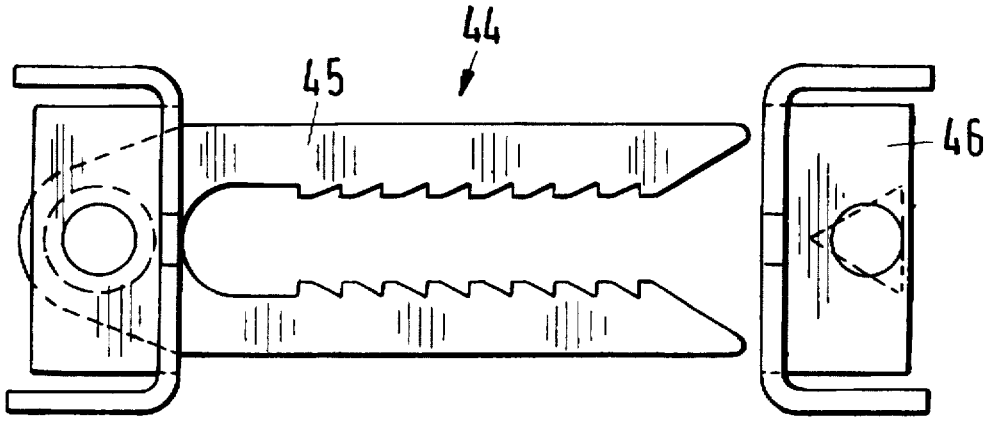
Figure 18B:
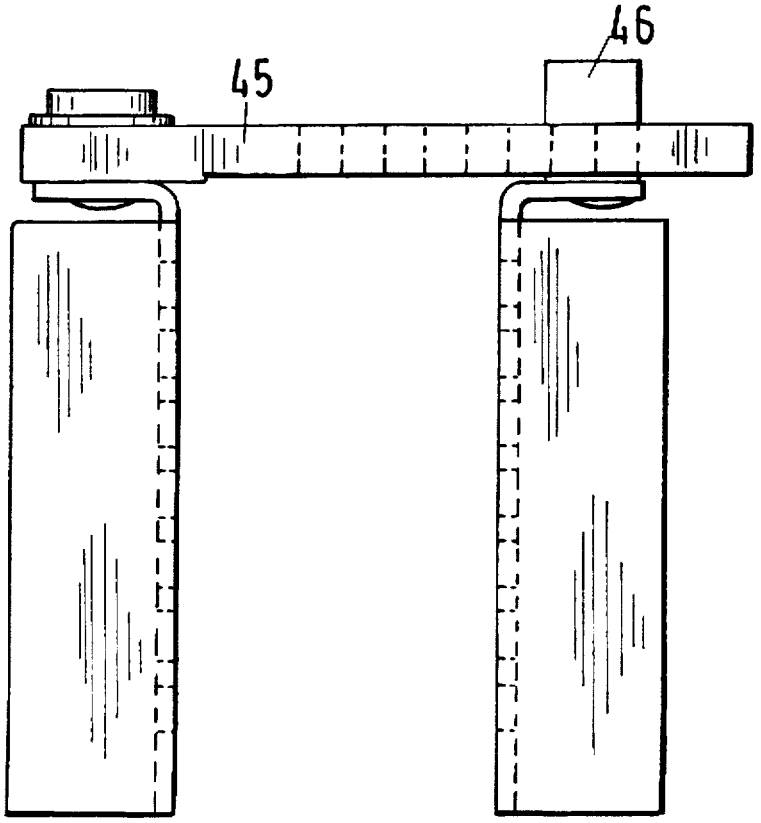

In order to cover the whole of the frame 1 with material 31, provisions are made to start at one corner of the frame 1, for example, in the region of the head frame part 5 and then to wrap the sheet-shaped material 34 around the frame 1 and fix it by means of the interlocking tapes 32, 35, until the second corner of the head frame 5 is reached. The material 34 is then wrapped around the frame 1 and the profiled legs 36 are placed on the welt 37 of the material sheet 34. The profiled legs 36 of the side frames 3 are fixed by means of the aforementioned stopper 34. For fastening the profiled leg 36 in the foot or head regions respectively, in each case a U-shaped clamping wire 43 is provided, which presses the profiled leg 36 against the foot frame part 4 or the head frame part 5. FIG. 17 shows that the clamping wire 43 is fastened, in turn, to the transverse bar 8. Overall, the material 34 can be connected to the metal plates 2 reliably and simply by these means.

Provisions can be made to cover the bed frame 1, including the head frame part 5, with material 31. It is, however, also conceivable not to cover the frame 1 in the region of the head frame part 5 with material, since the latter normally stands against the wall and, instead, to provide a separate head part (not shown here) with, for example, an ornamental design. This head part can be suspended in corresponding recesses in the head frame part 5 of the bedstead. Aside from the material covering described, it is also conceivable to distinguish the metal plates 2, which are made from aluminum, by means of a special design, so that it is possible to do without the material covering.

In order to make it possible to lock the two beds in the double bed position, locking means 44 are provided at each end of the transverse bar 8. Advantageously, these locking means 44 consist of a locking profile 45, which the downwardly directed locking pin 46 can engage. The locking profile 45 is mounted on the stationary bed, while the locking pin 46 is connected to the movable bed. The locking profile 45 is constructed in such a manner, that it makes possible different locking end positions, which depend on the thickness of the material 31 selected for the covering. As the height of the bed is being moved by the support 13, the locking pin 46 is easily pulled out of the locking profile 45, so that the lock is released. Moreover, the height, at which the locking means 44 are mounted, can be varied in order to be able to use variously designed metal plates 2. As the beds are being pushed apart into the single bed position, the locking profile 45 can be swiveled out of sight to the rear.

Overall, a bedstead is thus created, for which the mattress is held securely and, at the same time, when the two single beds are assembled into a double bed, there is a gapless transition between the two mattresses. Furthermore, the shifting mechanism makes it possible to move the two beds together or apart rapidly and with little effort, which is of great importance particularly in the hotel area, since the occupancy rate of a hotel room can be increased considerably by being able to use a room as a double bed room and as a room, which has two single beds. By selecting different materials to cover the metal plates, the bedstead can be adapted, for example to the decoration of the rest of the room.

I claim:

1. A bedstead movable between a first position and a second position transversely displaced from said first position comprising a bed structure having a longitudinal axis, at least one transverse bar on said bed structure, said transverse bar having an elongate axis perpendicular to said longitudinal axis of said bed structure, a base fixed to a floor, support means operable with said base for vertically moving said support means between a lowered position and an elevated positions, mounting means mounting said support means on said transverse bar such that when said support means moves between its lowered and elevated position, said transverse bar and said bed structure also move between lowered and elevated positions, said mounting means further mounting said support means on said traverse bar to provide for relative shifting movement between said support means and said transverse bar such that when said support means is in said elevated position at one longitudinal end of said transverse bar, the bed structure juxtaposed to the other end of the transfer bar is adapted to be manually raised so that the bed structure can be shifted transversely from said first position to said second position while being supported by said base via said support means and said mounting means.

2. A bedstead according to claim 1 wherein said bedstead is adapted to be used on the floor of a building structure, said base comprising a base structure and fastening means for fastening said base structure in a fixed position on said floor.

3. A bedstead according to claim 1 wherein said support means includes a support member, said mounting means comprising rollers on said support member and guide rails on said transverse bar which guide said rollers.

4. A bedstead according to claim 3 wherein one of said support member and said base has a slot and the other of said support member and said base has a pin slidable received in said slot, said mounting means including a cam member operable to engage said support member to effect movement of said support member relative to said base member as said pin slides in said slot.

5. A bedstead according to claim 4 wherein said pin is said on support member and said support member is pivotable about the axis of said pin.

6. A bedstead for accommodating a mattress comprising a bed structure having a bottom and a longitudinal side wall, said mattress being received in said bed structure to engage said bottom and said longitudinal side wall, said longitudinal side wall having a height less than the height of said mattress such that an upper side portion of said mattress is disposed higher than said longitudinal side wall, said longitudinal side wall of said bed structure underlying said upper side portion of said mattress such that said longitudinal side wall does not protrude beyond said upper side portion of said mattress, another like bed structure having another like mattress received therein, said first mentioned bed structure being positioned against said like bed structure such that the upper side portions of the mattresses on each bed structure engage one another without any gap therebetween.

7. A bedstead according to claim 6 wherein the first said bed structure has end walls and includes two of said longitudinal side walls such that said end walls and said longitudinal side walls circumscribe the mattress of the first said bed structure.

8. A bedstead according to claim 6 wherein the first said bed structure comprises a metal plate having bent corners which form said respective longitudinal side wall, the first said bed structure having a foot rail part and a head rail part, said metal plate having bent corners which form said respective foot rail part and said head rail part.

9. A bed comprising a first bedstead for accommodating a first mattress, said first bedstead comprising a first bed structure having a first bottom and a first longitudinal side wall, said first mattress being received in said first bed structure to engage said first bottom and said first longitudinal side wall, said first longitudinal side wall having a height less than the height of said first mattress such that an upper side portion of said first mattress is disposed higher than said first longitudinal side wall, said first longitudinal side wall of said first bed structure underlying said upper side portion of said first mattress such that said first longitudinal side wall does not protrude beyond said upper side portion of said first mattress, a second bedstead for accommodating a second mattress, said second bedstead comprising a second bed structure having a second bottom and a second longitudinal side wall, said second mattress being received in said second bed structure to engage said second bottom and said second longitudinal side wall, said second longitudinal side wall having a height less than the height of said second mattress such that an upper side portion of said second mattress is disposed higher than said second longitudinal said wall, said second longitudinal side wall underlying said upper side portion of said second mattress such that said side second longitudinal side wall does not protrude beyond said upper side portion of said second mattress, said first bed structure being positioned against said second bed structure such that upper side portion of said first mattress engages said upper side portion of said second mattress without any gap therebetween.

10. A bedstead for accommodating a mattress comprising a narrow-walled metal plate formed into a bed structure having a bottom and two longitudinal side walls, said bed structure having a longitudinal axis, transverse bars on said bed structure extending transversely of said longitudinal axis, fastening means fastening said transverse bars to said bed structure, said fastening means being disposed so as not to protrude externally of said longitudinal side walls of said bed frame, said mattress being received in said bed structure to engage said bottom and said longitudinal side walls, said longitudinal side walls having a height less than the height of said mattress such that an upper portion of said mattress is disposed higher than said two longitudinal side walls, said longitudinal side walls underlying said upper portion of said mattress such that said longitudinal side walls do not protrude beyond the sides of said mattress, whereby said bed structure is adapted to be positioned against another like bed structure in which the mattresses on each bed structure engage one another without any gap therebetween.

11. A bedstead according to claim 10 further comprising at least one setting foot mounted on at least one of said transverse bars, said setting foot having a bottom part, and roller means mounted on said bottom part.

12. A bedstead according to claim 10 further comprising a shifting mechanism on at least one of said transverse bars for shifting the bed structure between a lowered position and an elevated position, said shifting mechanism comprising a base disposed in a stationary position on a floor, a support means operable with said base for vertically moving said bed structure between said lowered position and elevated positions, and mounting means mounting said support means on said one transfer bar to provide for relative shifting movement between said support means and said one transverse bar.

13. A bedstead according to claim 12 wherein said support means comprises a support element and an eccentric member mounted on said base, said engageable member being engageable with said support element such that rotation of said eccentric member moves said support element between the lowered and elevated positions.

14. A bedstead according to claim 13 further comprising drive means on said base for driving said eccentric member, said drive means including two gears of different radii with the smaller of the two gears driving the larger of the two gears, said larger of the two gears driving said eccentric member.

15. A bedstead according to claim 14 wherein said shifting mechanism is provide on said one transverse bar and another like shifting mechanism is provided on another transverse bar, the smaller of the two gears of the driving means of both said shifting mechanisms being mounted on a common shaft.

16. A bedstead according to claim 13 wherein said base comprises two half shells and connecting means connecting said two half shells, said two connected half shells defining an accommodation space therebetween, said eccentric member and said support means being at least partially disposed in said accommodation space.

17. A bedstead according to claim 12 wherein said one transverse bar includes guide rails, said mounting means comprising rollers for rotatably guiding said support means on said guide rails.

18. A bedstead according to claim 12 wherein said one transverse bar is provided with stops operable to engage said support means, said stops comprising integral one-piece lugs extending downwardly from said one transverse bar.

19. A bedstead according to claim 12 wherein said one transverse bar has two end portions each provided with a recess, said longitudinal side walls having inwardly extending tabs which are received in said recesses.

20. A bedstead according to claim 19 wherein said bed structure has a head part and a foot part, further comprising a material covering disposed about said longitudinal side walls , said head part and said foot part, and a hook and eyelet tape for securing one part of said material to said longitudinal side walls, said head part and said foot part, said bed frame having a profiled member extending at least partially about said bed frame, said profile member having a slotted opening, said covering material having a thickened wall received in said slotted opening.

21. A bedstead according to claim 20 further comprising locking means on said bed structure operable to lockingly engage a locking member on another bed structure when the two bed structures are generally horizontally disposed, said locking means being adopted to be unlocked from said locking member when the bed structure having the locking means is raised relative to said other bed structure.

* * * * *